United States Patent [19]

Pujol

[11] 4,078,731

[45] Mar. 14, 1978

[54] COOLED HORIZONTAL-AXLE GRINDER

[76] Inventor: Carlos Oliver Pujol, Marina Street No. 51, Badalona (Barcelona), Spain

[21] Appl. No.: 765,976

[22] Filed: Feb. 7, 1977

[30] Foreign Application Priority Data

Nov. 6, 1976 Spain ..... 453.094

[51] Int. Cl.[2] ..... B02C 17/18

[52] U.S. Cl. ..... 241/65

[58] Field of Search ..... 241/65, 66

[56] References Cited

U.S. PATENT DOCUMENTS

| | | | |
|---|---|---|---|
| 2,200,997 | 5/1940 | Royle | 241/65 |
| 3,171,604 | 3/1965 | Conley et al. | 241/65 |
| 3,709,442 | 1/1973 | Consoli | 241/65 |

*Primary Examiner*—Granville Y. Custer, Jr.

*Attorney, Agent, or Firm*—Blanchard, Flynn, Thiel, Boutell & Tanis

[57] ABSTRACT

A cooled horizontal axle grinder for the predispersion of solids in liquids, of the type which incorporates a grinding chamber in which are present grinding bodies such as balls generally introduced by the treated product intake port and extracted by an outlet in the lower part of the chamber. The grinder is equipped with a circulating pump for the product to be treated, which product circulates in a continuous manner through the grinding chamber. The grinder axle carries interchangeable discs or agitator elements interspersed with spacers. The grinding chamber incorporates a slot or static sieve which retains the grinding bodies in the chamber while permitting passage only of the product. The grinding chamber jacket has a helical cooling passage therein which extends axially of the grinding chamber in surrounding relationship thereto.

3 Claims, 3 Drawing Figures

1
2
3
3'
3''
4
5
7
8
9
10
11
12
13
14
15
16
17
18
21
22
23
25

COOLED HORIZONTAL-AXLE GRINDER

FIELD OF THE INVENTION

The present invention refers to improvements in cooled horizontal-axle grinders for the predispersion of solids in liquids and, in particular, to improvements in the grinder disclosed in my copending application Ser. No. 729,298, filed Oct. 4, 1976.

BACKGROUND OF THE INVENTION

In my above-mentioned application, the machine considered was of the type consisting of a horizontal axle grinder whose grinding chamber jacket is mounted in an unconstrained arrangement, thereby permitting the absorption of differential expansion between the internal and external parts of the chamber so as to avoid cracks or rupture in the chamber body welding.

The improvements which are the object of this invention consist of equipping the chamber jacket with a new type of cooling circuit which is composed of two transverse peripheral grooves in the exterior of the grinding chamber, where there is one of these grooves at each end of the chamber and their object is to collect the input and output liquid coolant, and between these grooves runs a helical channel for the forced passage of the liquid coolant.

With this system notable advantages are obtained over the conventional system shown in the above-mentioned application; these are:

an increase in the cooling area;

a greater temperature gradient in the cooling water which removes heat from the product in the interior;

a greater temperature uniformity in the grinding chamber and a greater heat transmission between its interior and exterior.

DETAILED DESCRIPTION

Figures 1, 2:
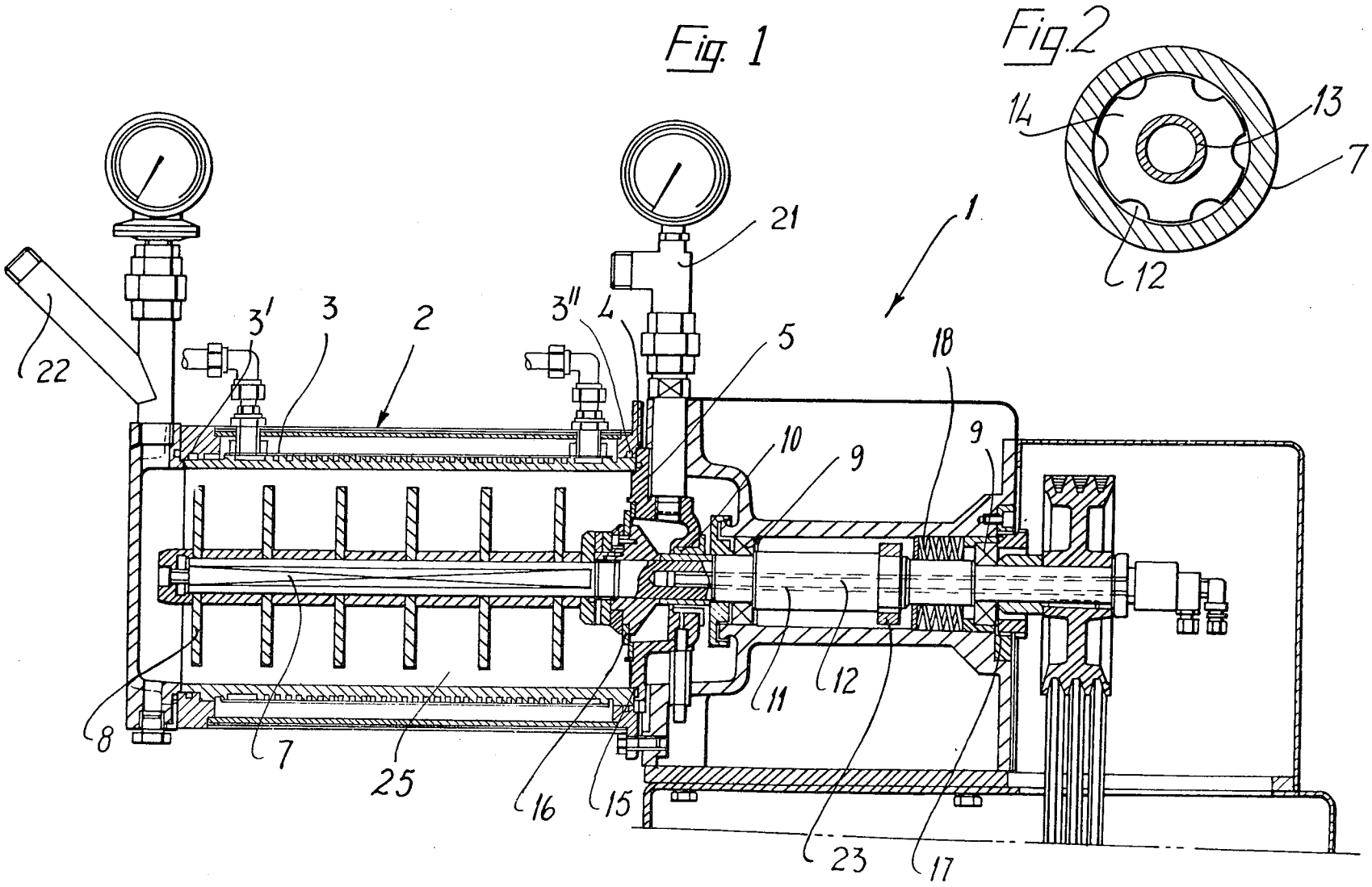
FIG. 1 corresponds to a longitudinal sectional view in elevation of the grinding chamber and the axle support.
FIG. 2 shows a transverse section through the axle, and demonstrates schematically the axle cooling system.

With reference to FIG. 1, there is shown a machine 1 of a type which includes a grinder 2, with a horizontal axle, and a grinding chamber jacket 3 which is mounted in an unconstrained arrangement by means of an annular flange 4 at one of its extremes and permits the jacket 3 to be fixed to the body 5, while leaving the opposite extreme of the jacket totally free to permit the absorption of the differential expansion between the internal grinding and mixing chamber 25 and the external structure 6, thus avoiding cracks or ruptures in the chamber body welding caused by the stresses set up by any differential expansion between its component parts. Annual sealing joints can be situated around the jacket 3, in particular at its extremes 3' and 3''.

The inlet tube 22 communicates with one end of the chamber defined within the jacket 3 so as to supply the product thereto. The product is removed from this chamber via the outlet tube 21.

The rotatable axle or shaft 7, on which is mounted the agitator discs 8, is equipped with a cooling system designed to dissipate the heat generated in those areas subject to friction, whether in the axial bearings, or the rotary bearings 9 or in the sealing or tightening element 10. To this end, the axle 7 is equipped with an interior axial conduit 12 in the rearward support area 11, in which conduit there is situated a tube 13, on the extreme end of which is mounted a teflon guide 14 (FIG. 2). This cooling system includes a rotatable dual-passage joint 24 mounted on friction seals. Its function is to permit the introduction and drainage of the cooling water by means of the interior of tube 13 and the annular space which exists between this tube and the internal wall of the axial conduit 12.

As is known, this type of grinder machine has an element which acts as a filter, and which retains, in the interior of the grinding chamber, the grinding bodies while giving passage only to the product as it is treated. In FIG. 1, there is shown a filtering element of known type such as "a slot filter" which is composed of two parts, one part 15 being stationary while the other part 16 rotates with the axle 7. The separation space or annular "slot" which exists between parts 15 and 16 is adjustable within certain limits, by means of an adjustment mechanism which includes the rotatable threaded sleeve 17 and the flexible washer-type springs 18.

The cooling system for the sealing element 10 can be realized by means of a membrane pump of known type as employed in gasoline automobiles, which pump is activated by means of an eccentric 23 situated on the grinder shaft. This eccentric acts on the corresponding operating rod of the pump.

The structure as described above corresponds to the grinder disclosed in my above-mentioned application Ser. No. 297,298.

Figure 3:
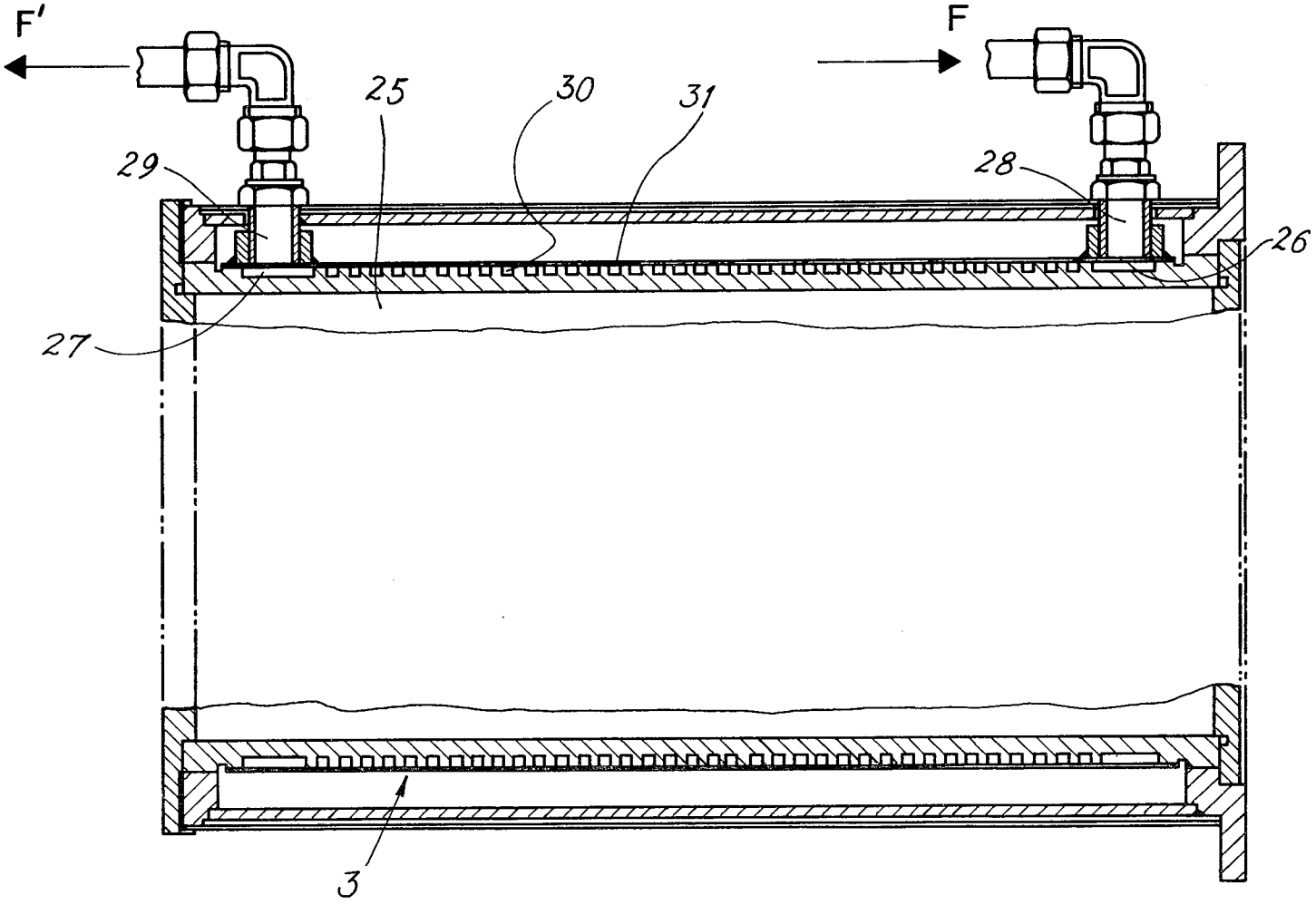
FIG. 3 shows an improved cooling jacket for the grinder, which jacket is constructed in accordance with the present invention.

Considering now the present invention, and as shown in FIG. 3, this invention relates to an improved cooling jacket 3 which can be used in conjunction with the grinder 2 shown in FIGS. 1 and 2.

The cooling jacket 3, which defines therein the grinding chamber 25, has two circular, peripheral and transverse grooves 26 and 27 extending therearound, one at each end of the grinding chamber. The object of these grooves is to act as collectors for the input and output cooling water, as shown by the arrows F and F' respectively. The input groove 26 thus communicates with an inlet pipe 28, and the outlet groove similarly communicates with a discharge pipe 29. Axially between the grooves 26 and 27, there is provided a helical channel 30 which is formed in the wall of the jacket so as to surround the grinding chamber. The opposite ends of channel 30 communicate with grooves 26 and 27 so as to permit the forced passage of cooling water therethrough. The jacket has a surrounding outer sleeve 31 which closes the outer boundary of the channel 30.

By using the above-described configuration, the cooling surface is increased, thereby giving rise to a greater temperature gradient in the cooling water which removes heat from the product in the grinding chamber; it also produces a greater uniformity in the grinding chamber temperature and a greater heat transmission between its interior and exterior.

The invention, in essence, may be implemented in other forms of realization which may differ from that outlined by way of an example in the description, but which will equally receive the patent protection obtained. Thus, it may be constructed in whatever shape or form, and with whatever materials and means most suitable, while all of this remains encompassed within the spirit of the claims.

The embodiments of the invention in which an exclusive property or privilege is claimed are defined as follows:

1. In a cooled horizontal-axle grinder, such as for the predispersion of solids in liquids, which grinder includes wall means defining therein a grinding chamber, grinding bodies such as balls positioned within said grinding chamber, a rotatable agitator shaft extending through said grinding chamber and supported for rotation about a substantially horizontal axis, said shaft having agitator elements mounted thereon, and passage means communicating with said grinding chamber for permitting extraction of the treated product therefrom while retaining the grinding bodies in the chamber, comprising the improvement wherein said wall means includes an axially elongated sleevelike jacket extending coaxially of and positioned in surrounding relationship to said shaft for defining said gringing chamber therein, first and second annular grooves positioned in encircling relationship to said jacket adjacent the opposite axial ends thereof, a helically extending channel formed in the outer peripheral wall of said jacket, said channel having the opposite ends thereof respectively in communication with said first and second grooves, a cylindrical shroud fixedly positioned in surrounding relationship to said jacket for closing the outer periphery of said chamber whereby direct flow communication between said first and second grooves can occur only through said helical channel, and first and second conduit means communicating respectively with said first and second annular grooves for permitting liquid coolant to be supplied to one of said grooves and discharged from the other of said grooves.

2. A grinder according to claim 1, wherein said jacket comprises a one-piece integral sleeve member having a sidewall defined between interior and exterior peripheral surfaces, said interior peripheral surface defining the outer boundary of said grinding chamber, and said helical channel being formed directly in said sidewall and projecting radially inwardly from said exterior peripheral surface so that the channel opens outwardly of said sleeve member through said exterior peripheral surface, and said cylindrical shroud being positioned in engagement with said exterior peripheral surface for closing the outer periphery of said channel.

3. A grinder according to claim 2, wherein said channel includes a large number of flights which completely encircle said jacket and are positioned closely adjacent one another and extend throughout substantially the complete axial length of the jacket as measured between said first and second annular grooves.

* * * * *

UNITED STATES PATENT AND TRADEMARK OFFICE

CERTIFICATE OF CORRECTION

PATENT NO. : 4 078 731

DATED : March 14, 1978

INVENTOR(S) : Carlos Oliver Pujol

It is certified that error appears in the above-identified patent and that said Letters Patent are hereby corrected as shown below:

Column 3, Line 21; change "gringing" to ---grinding---.

Column 4, Line 2; change "chamber" to ---channel---.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*